US010612880B1

(12) United States Patent
Ding et al.

(10) Patent No.: US 10,612,880 B1
(45) Date of Patent: Apr. 7, 2020

(54) ADJUSTABLE INDEX MOUNT FOR FIREARMS

(71) Applicant: Leapers, Inc., Livonia, MI (US)

(72) Inventors: Tai-lai Ding, Northville, MI (US); Tat Shing Yu, Plymouth, MI (US)

(73) Assignee: LEAPERS, INC., Livonia, MI (US)

( * ) Notice: Subject to any disclaimer, the term of this patent is extended or adjusted under 35 U.S.C. 154(b) by 0 days.

(21) Appl. No.: 16/247,051

(22) Filed: Jan. 14, 2019

(51) Int. Cl.
*F41A 35/06* (2006.01)
*F41C 23/16* (2006.01)
*F41C 27/00* (2006.01)

(52) U.S. Cl.
CPC ..... *F41A 35/06* (2013.01); *F41C 23/16* (2013.01); *F41C 27/00* (2013.01)

(58) Field of Classification Search
CPC ..... F41C 23/12; F41C 23/16; F41A 35/06
USPC ..... 42/72, 73
See application file for complete search history.

(56) References Cited

U.S. PATENT DOCUMENTS 3,348,328 A * 10/1967 Earl ..... F41C 23/04 42/73
5,630,535 A * 5/1997 Valenti ..... A45F 5/02 224/191
D658,263 S 4/2012 Nierenberg
8,695,477 B2 * 4/2014 Esch ..... F41A 17/42 42/14
2013/0333263 A1 * 12/2013 Hovey ..... F41C 23/16 42/72
2014/0373414 A1 * 12/2014 Nierenberg ..... F41A 3/66 42/1.06

FOREIGN PATENT DOCUMENTS

WO WO-2014123628 A2 * 8/2014 ..... F41C 3/00

OTHER PUBLICATIONS

STI Double-Alpha Adjustable Thumb Rest downloaded from https://www.midwayusa.com/product/2670114318/double-alpha-adjustable-thumb-rest-3-hole-sti-2011-aluminum on Dec. 28, 2018.
Blackhawk Rail Mounted Thumb Rest downloaded from https://www.grainger.com/product/BLACKHAWK-Rail-Mounted-Thumb-Rest-45G459?cm_sp=Product_Details-_-Products_Based_on_Your_Search-_-IDPPLARECS&cm_vc=IDPPLARECS on Dec. 28, 2018.
GoGun AR-15 Polymer Gas Pedal downloaded from http://www.ar15news.com/2011/11/05/new-gogun-usa-ar-15-polymer-gas-pedal/ on Dec. 28, 2018.

(Continued)

*Primary Examiner* — Stephen Johnson
(74) *Attorney, Agent, or Firm* — Warner Norcross + Judd LLP

(57) ABSTRACT

An index mount for a firearm includes a mounting base, a connector flange and a selectively configurable paddle, joined with the connector flange, and configured to establish a resting surface to index a digit of a user relative to the firearm and consistently establish a particular grip relative to the firearm. The mount can include an indexing element that aligns and/or sets the paddle in first or second positions relative to the mounting base. The paddle can be configured with a forward cant and/or a rearward cant and can be adjusted to fit the user's preferences. The paddle can include an upper surface canted at an outward angle between 55° and 85°, inclusive. A related method of use is provided.

20 Claims, 8 Drawing Sheets

(56) References Cited

OTHER PUBLICATIONS

Knights Armament AR-15 Top Rail Thumb Rest Rubber downloaded from https://globalordnance.com/knights-armament-company-top-rail-rubber-thumb-rest-fits-picatinny-black-finish-30537-upc-819064010524/ on Dec. 28, 2018.
AWT Handguard Thumb Rest downloaded from https://www.shootersconnectionstore.com/AWT-Handguard-Thumb-Rest-P5082.aspx on Dec. 28, 2018.
ACI TMRS Left Thumb Rest for KeyMod & M-LOK downloaded from https://static.airsoftcart.com/11716-large_default/aci-tmrs-left-thumb-rest-for-keymod-and-mlok-red.jpg on Dec. 28, 2018.

* cited by examiner

ADJUSTABLE INDEX MOUNT FOR FIREARMS

BACKGROUND OF THE INVENTION

The present invention relates to firearms, and more particularly to an adjustable index mount that assists a user in establishing a consistent and comfortable grip on a firearm.

There is a variety of accessories available to consumers to customize their firearms, particularly modern sporting rifles, such as the AR15. Some of these accessories include pistol grips, angled fore grips, hand stops and barricade rests. These components can be attached to a firearm, such as a rifle, like the AR15. When attached to a rifle, these components typically are joined with the front handguard covering the barrel of the firearm. When in place, these components can assist a user in operating the firearm in a consistent manner. Most of these components are rigid, immovable projections against which a user can index a hand or digits to establish a solid, consistent grip on the firearm. Thus, when using the firearm, the user can attain a proper and consistent shooting form, which in turn can improve shooting accuracy.

While these components are helpful in gripping and controlling the firearm, they can be tedious to set up and properly configure for users of different stature. A component might work for one user's body type or user's grip style, however, that same component may be completely incompatible with another user's body type or grip. Further, these components can vary in size, with some being rather large and projecting too far away from the firearm, thereby increasing the likelihood of snagging that component on clothing or other objects. In addition, because these components are stationary, a user may have to experiment and reposition the components in different areas of the firearm, requiring disassembly and removal from the firearm.

Accordingly, there remains room for improvement in the field of grip and indexing components for firearms.

SUMMARY OF THE INVENTION

An adjustable index mount for a firearm includes a mounting base, a connector flange and a selectively configurable paddle, joined with the connector flange, and configured to establish a resting surface to index a digit of a user relative to the firearm and consistently establish a particular grip relative to the firearm.

In one embodiment, the mount can include an indexing element that aligns and sets the paddle in first or second positions relative to the mounting base. The paddle can be configured with a forward cant and/or a rearward cant, and adjusted to fit the user's preferences. Optionally, the forward and/or rearward cants can be between 1° and 45°, inclusive, relative to a horizontal reference line of the mounting base when the paddle is in the first position or second position respectively. This can enable the user to set the forward and/or rearward cants of the paddle upper surface to more comfortably fit the user and their preferences.

In another embodiment, the paddle can include an upper surface canted at an outward angle between 55° and 85°, inclusive, and optionally 75° relative to vertical reference line of the mounting base. This can more naturally conform to a user's digits when engaging the index mount, for example, a thumb of the user resting on the paddle.

In a further embodiment, the paddle can include an inner edge and can project toward a bisecting plane of the firearm. The paddle thus can extend toward that plane and over an outward projecting part of the handguard. In some cases, the inner edge of the paddle can be disposed at least ⅛" beyond an interior surface of the mounting base. This configuration can reduce the lateral profile of the paddle on the firearm. This can allow the paddle to be large enough to easily find and index a digit on it, but small enough so that the paddle does not inadvertently snag on clothing and objects.

In still another embodiment, the mounting base can define a flange cradle. The connector flange can be selectively movable within the confines of the flange cradle, such that even when certain indexing elements of the mount are disengaged from one another, the connector flange is at least partially restrained in the cradle to prevent loss or disassociation of the paddle and flange from the mounting base.

In yet another embodiment, the mounting base can include a first base stop and a second base stop opposing one another across the flange cradle. The connector flange can include a first edge and a second edge. The first edge can be adjacent the first base stop when the paddle is in the first position, but the second edge can be adjacent the second base stop when the paddle is in the second position. Optionally, the first edge can be closer to the first base stop when the paddle is in the first position than when the paddle is in the second position, and the second base stop can be closer to the second base stop when the paddle is in the second position than when the paddle is in the first position.

In even another embodiment, the index mount includes one or more indexing elements that maintain the paddle in the first position or second position when interlocked or engaging one another. One indexing element can be on the connector flange, and another corresponding element can be on the mounting base. The indexing elements optionally can be in the form of posts and recesses. The posts can fit in or register with the recesses to maintain the connector flange in a fixed position relative to the mounting base, thereby locking the paddle in the first position or the second position.

In a further embodiment, the index mount can be ambidextrously mounted on either side of a handguard or portion of a firearm. In this manner, the mount can be easily utilized by left or right handed shooters who may index different digits on different sides of the firearm.

In still a further embodiment, a method of using an adjustable index mount on a firearm is provided. The method can include mounting a mounting base adjacent a first surface of a firearm with a mounting fastener, the mounting base including a horizontal reference line; projecting a paddle having an upper surface over a second surface of the firearm toward a bisecting plane of the firearm, such that the paddle juts inward, over the second surface and reduces the lateral profile of the paddle on the firearm; and selectively configuring the paddle in a first position or a second position relative to the mounting base, such that the upper surface is canted at a rearward angle or at a forward angle, or a neutral angle, relative to the horizontal reference line when the paddle is in the second position. A user can selectively position the paddle in the first position or the second position so that the user can engage the paddle with a digit and consistently establish a particular grip relative to the firearm.

In yet a further embodiment, the method can include rotating the connector flange about an axis of rotation to align a first indexing element with a second indexing element. During the rotating, the upper surface of the paddle can transition from being canted at the rearward angle to being canted at the forward angle or vice versa.

The current embodiments of the adjustable index mount and method of installation provide benefits related to firearm components that previously have been unachievable. For example, with the present index mount, a user can quickly and efficiently install the mount and then adjust it to precisely fit the user's preferences and grip. The index mount also can provide an ambidextrous locking system on a modular handguard. The mount can provide improved recoil management and enhance rapid fire stability due to the consistent placement of a user's digits and/or hand on the firearm. The selectively configurable mount can have a forward cant, a neutral cant and/or a rearward cant to allow a user to precisely customize the index mount to their particular grip. The inward projection of the paddle also reduces the lateral profile of the index mount to provide enhanced maneuverability.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
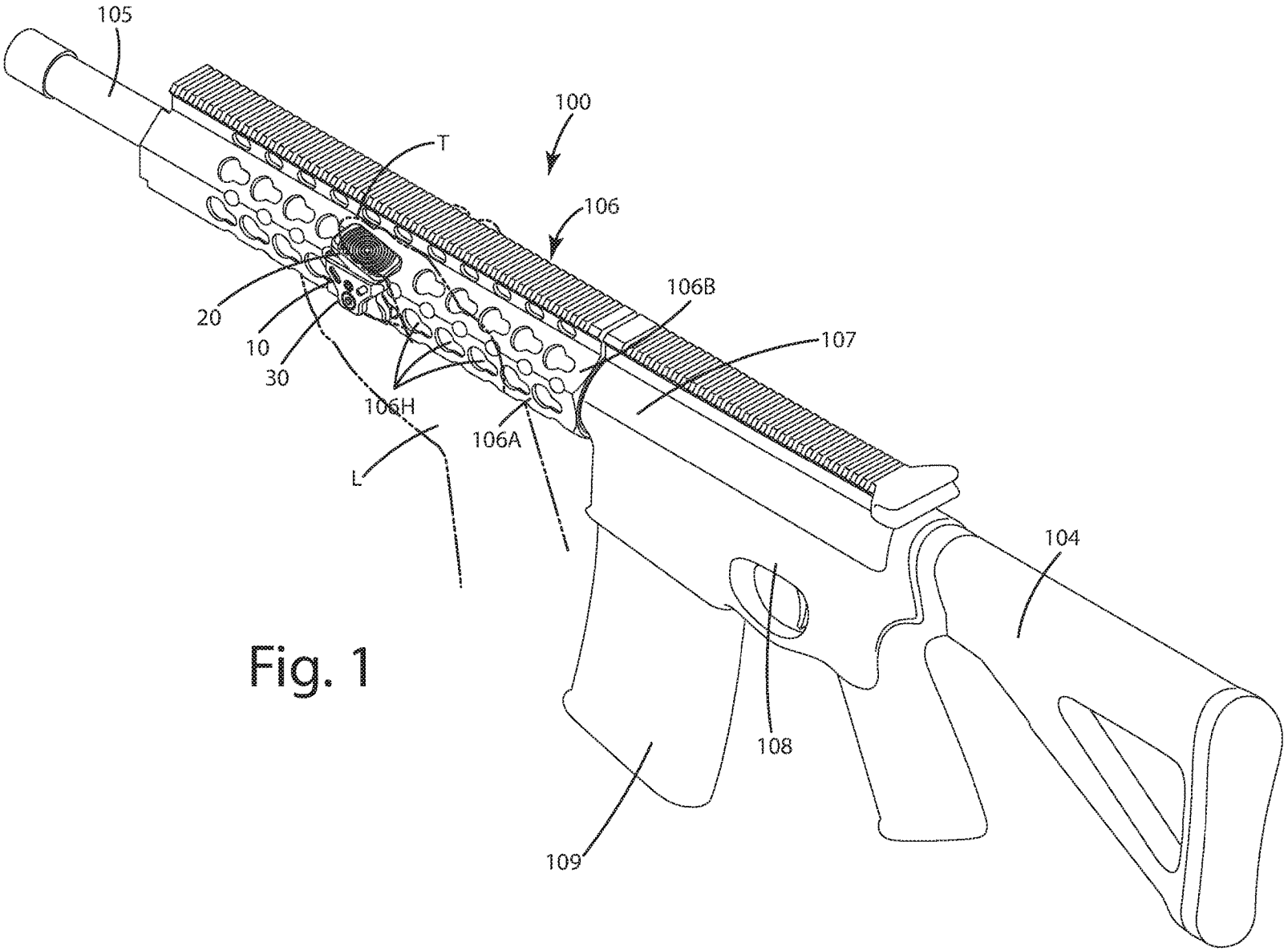
FIG. 1 is a perspective view of the index mount of a current embodiment canted rearward in a first position and installed on a firearm.

A current embodiment of an adjustable index mount 10 for a firearm is illustrated in FIGS. 1-9 and generally designated 10. The index mount is configured to be mounted to a firearm, for example a handguard of a firearm 100. The firearm 100 illustrated is in the form of an AR-15, but of course can be any other type of firearm. The firearm 100 can include a stock 104 configured to shoulder against a user, a barrel 105, a handguard 106, an upper receiver 107 and a lower receiver 108, which is configured to receive a removable magazine 109. The firearm can be split into left and right halves by a bisecting plane BP. The index mount can be mounted to the handguard as shown, but with other firearms or weapons, can be mounted to other parts of those items, such as a frame, a stock, a slide, upper or lower receivers or the like. The index mount 10 also is shown as being configured to mount to holes 106H defined by the handguard, or alternatively, directly to a picatinny rail or other component of a weapon. Where included, the holes can be defined by the handguard or other components of the firearm. These holes optionally can be constructed in an M-LOK configuration or a KEY MOD configuration as shown, which generally identify the shape and configuration of the holes as will be appreciated by those of skill in the art.

With reference to FIG. 1, the index mount 10 is set up on the handguard 106 for a right-handed shooter, who normally can engage the handguard with the user's left hand L. In particular, the user's left hand L thumb T can engage the paddle 20 which is mounted to the base 30 of the index mount 10. The paddle 20 as shown is in a rearward canted orientation, generally in what can be referred to as a first position herein. As will be understood in the disclosure herein, that paddle and its upper surface can be adjusted so that it can fit the user's precise positioning of their thumb T relative to the index mount 10 to thereby allow the user to quickly find an index the handguard 106 and thus the weapon 100 in the user's control.

Figure 2:
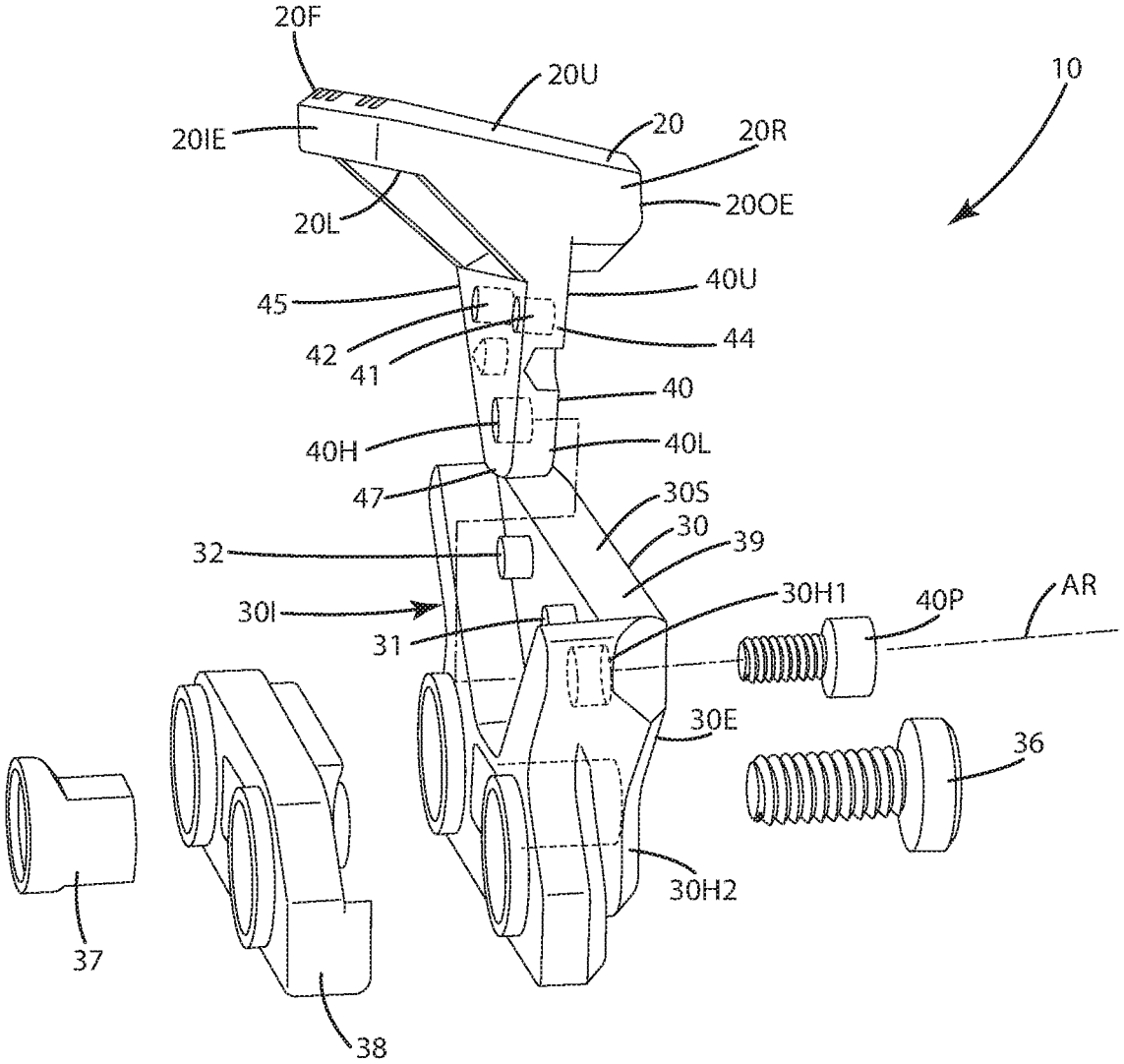
FIG. 2 is an exploded view of the index mount.

With reference to FIG. 2, the index mount 10 can include the mounting base 30, a paddle 20 and a connector flange 40 that joins the paddle and the mounting base. The paddle 20 and the connector flange 40 can be an integral one piece part or joined with one another as separate parts. The paddle can include an upper surface 20U and a lower surface 20L. The paddle also can include an inner edge 20IE and an outer edge 200E. These edges can be connected with a paddle front edge 20F and a paddle rear edge 20R. The upper surface 20U can be configured as a planar surface as shown, or alternatively it can be configured as a rounded, angled, contoured, textured or other surface. The upper surface 20U as shown also can include a gripping surface which can provide an aggressive no slip texture to improve recoil management or the like.

Figure 7:
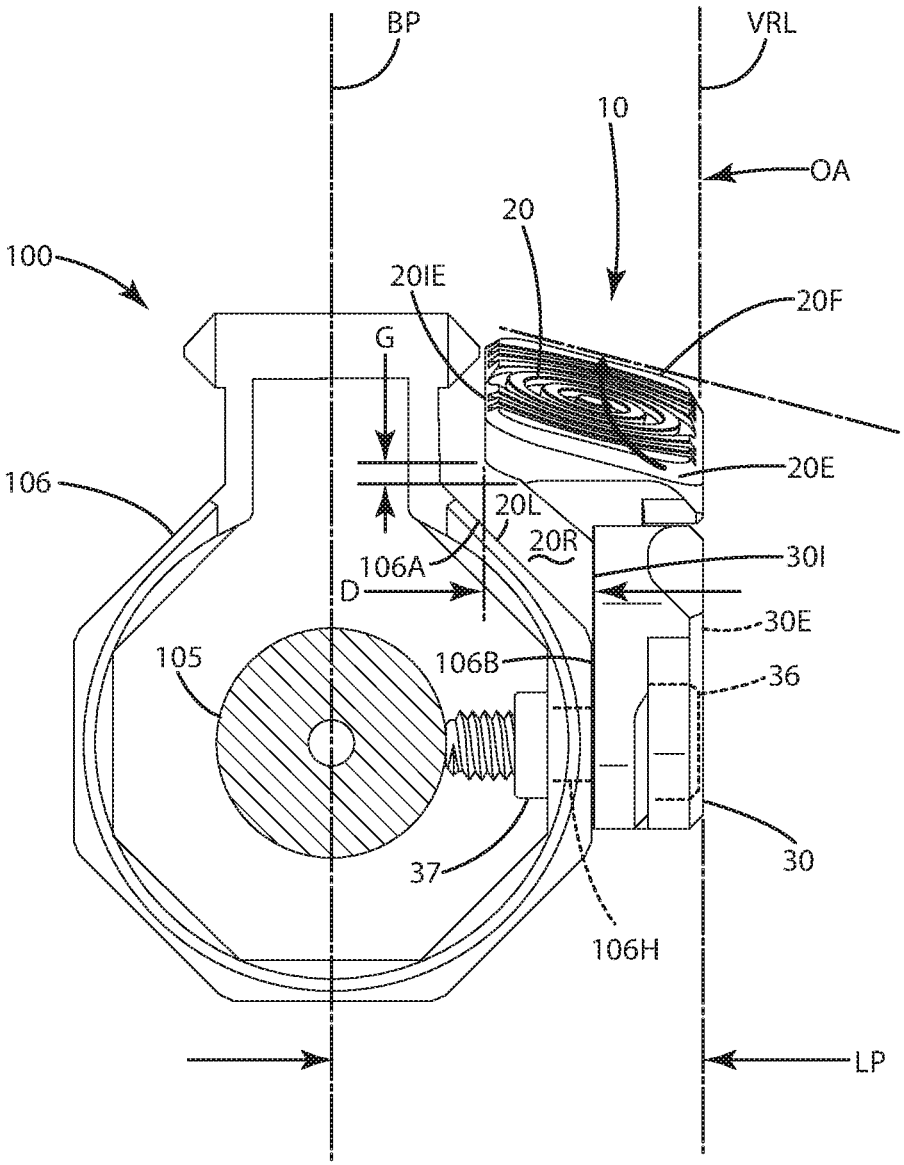
FIG. 7 is a side view of the index mount mounted to a handguard of the firearm, with a paddle extending inwardly over a handguard surface, toward a bisecting plane of the firearm, to reduce the overall lateral profile of the index mount on the firearm.

As shown in FIG. 7, the interior edge 20IE and the paddle 20 in general can extend a distance D inward from the interior surface 30I. This distance D can be configured so that the inner edge 20IE is disposed over the mounting element 37 when the index mount 10 is installed on the firearm 100. This distance D also can ensure that the paddle 20 extends over the outwardly projecting handguard surface 106A so as to reduce its lateral profile LP on the firearm. This distance D can be optionally at least ⅛", at least ¼", at least ½", between ⅛" and 1" inclusive, between ⅛" and ½", inclusive, beyond the interior surface 30I of the mounting base 30. Of course, depending on the handguard configuration, the precise size can be modified. Where the paddle 20 and its lower surface 20L transition to the interior surface 30I, the area bounded by the lower surface 20L and the interior surface 30I can form a handguard recess 20R. This recess is configured to receive a portion of the handguard guard, for example, the outwardly projecting surface 106A. In this manner, the paddle and lower surface extend over that portion of the handguard to reduce the overall lateral profile LP of the index mount 10.

The paddle 20 can be joined at its lower surface and can transition to the upper portion 40U of the connector flange 40. The upper portion can transition and tapered downward to a lower portion 40L. The upper portion 40U of the connector flange 40 can include first indexing elements 41A, 41B, and 42A, 42B. The first indexing elements can be considered a set of indexing elements. As shown, the indexing elements can be in the form of recesses, which form recesses, holes, grooves, valleys, indentations, detents or other structures, all referred to as recesses herein. The connector flange 40 can include a first edge 44 and a second edge 45. These edges can cooperatively form a portion of a triangular shape having a truncated tip 47 at the lowermost portion of the connector flange 40. The connector flange also can include a flange centerline FCL that can generally align with the vertical centerline of the paddle 20 and flange 40. As described below, this flange centerline FCL can have different orientations relative to a vertical reference line or centerline VRL of the base 30.

The connector flange 40 can be include a pivot hole 40H in the lower portion 40L. The pivot hole can be optionally threaded and can receive a correspondingly threaded pivot fastener 40P. The pivot fastener 40P can thread into the threaded hole 40H of the connector flange, but optionally, the threads might not engage a corresponding hole 30H1 defined in a side wall 30S of mounting base 30. In this manner, the flange and paddle can pivot when being adjusted along with the pivot fastener 40P.

Figure 3:
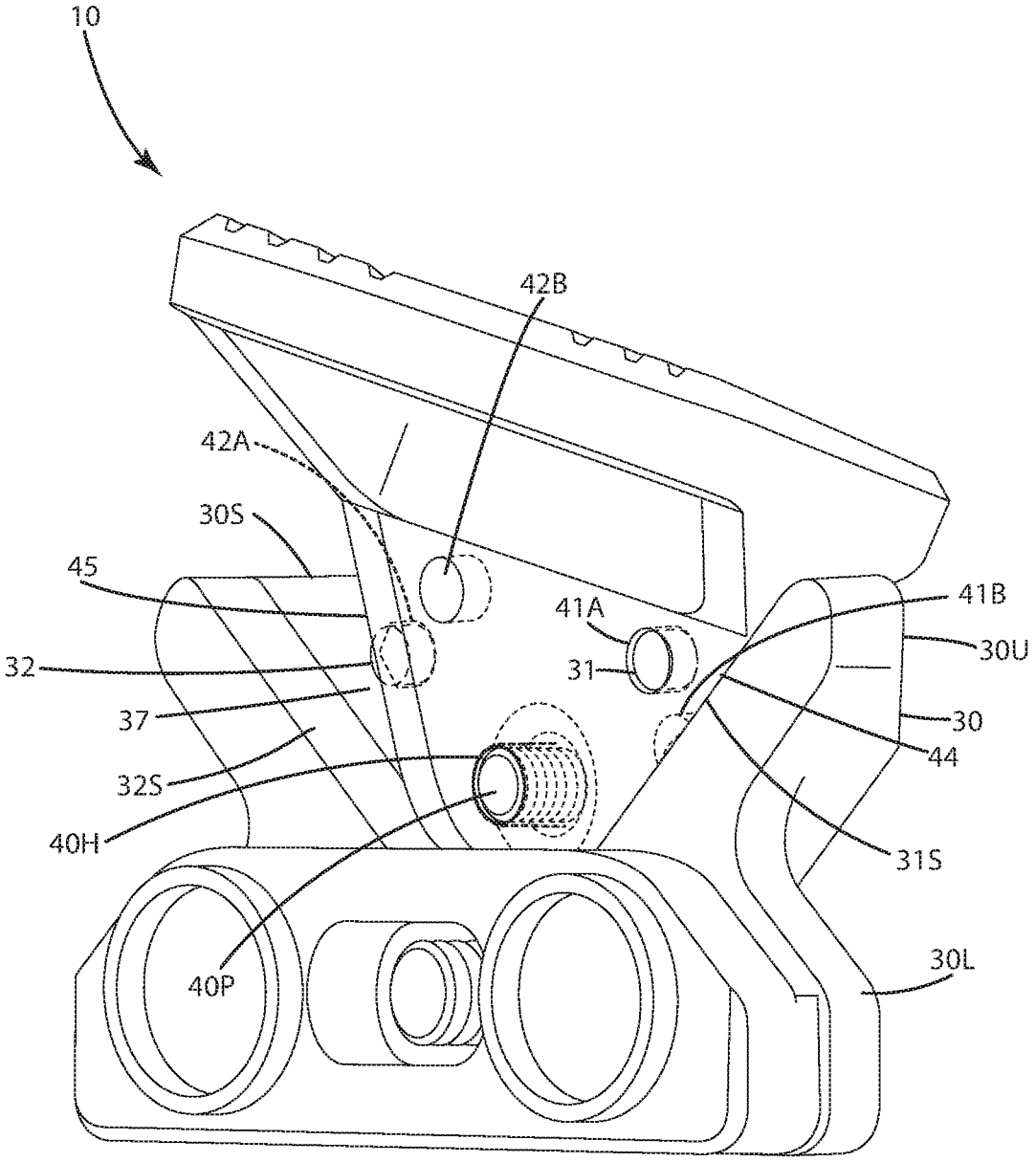
FIG. 3 is a rear view of the index mount canted rearward in a first position, with indexing elements engaging one another.
Figure 4:
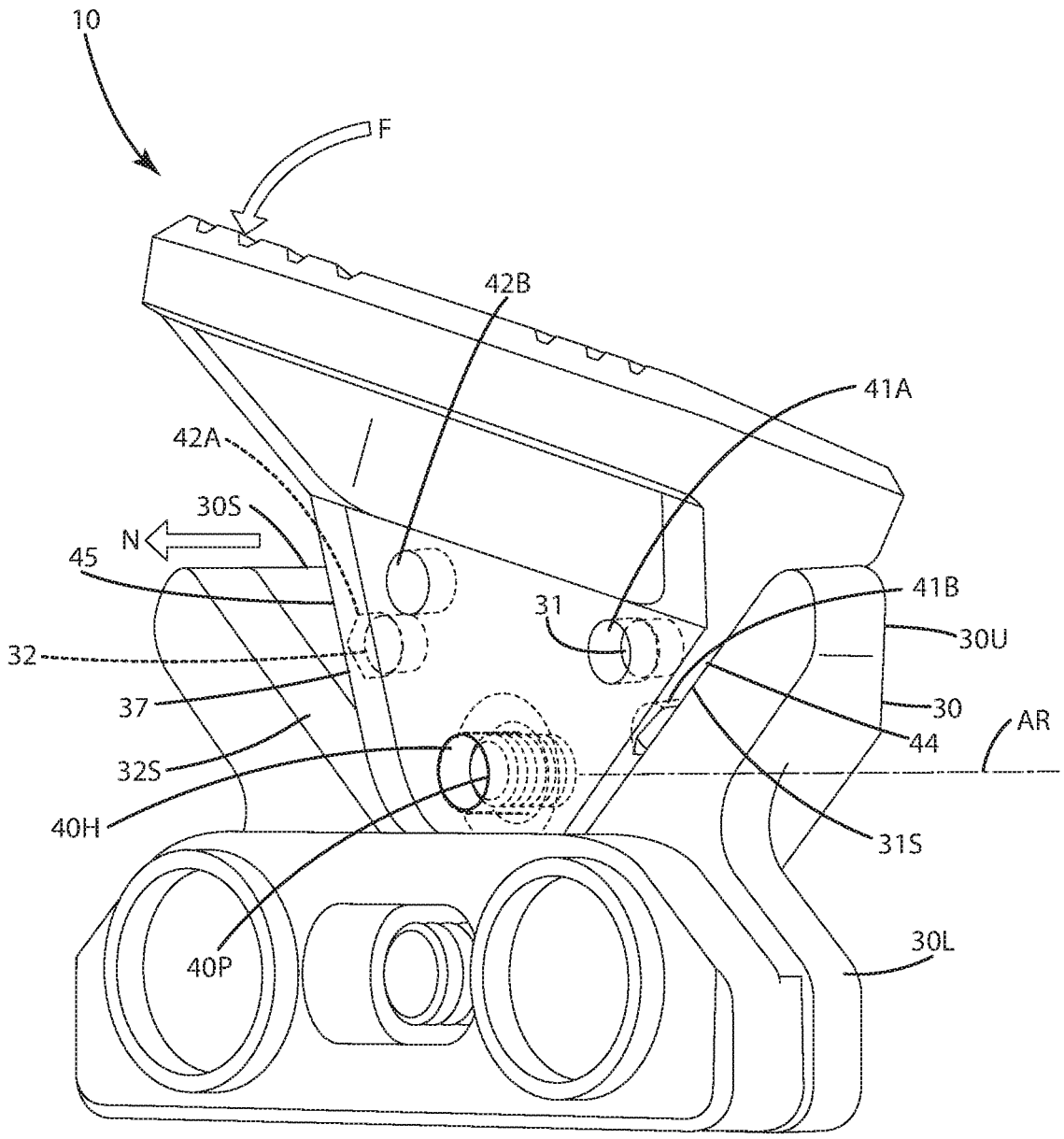
FIG. 4 is rear view of the index mount being selectively adjusted from the first position, with the indexing elements disengaged from one another and the connector flange about to be moved in the flange cradle.
Figure 9:
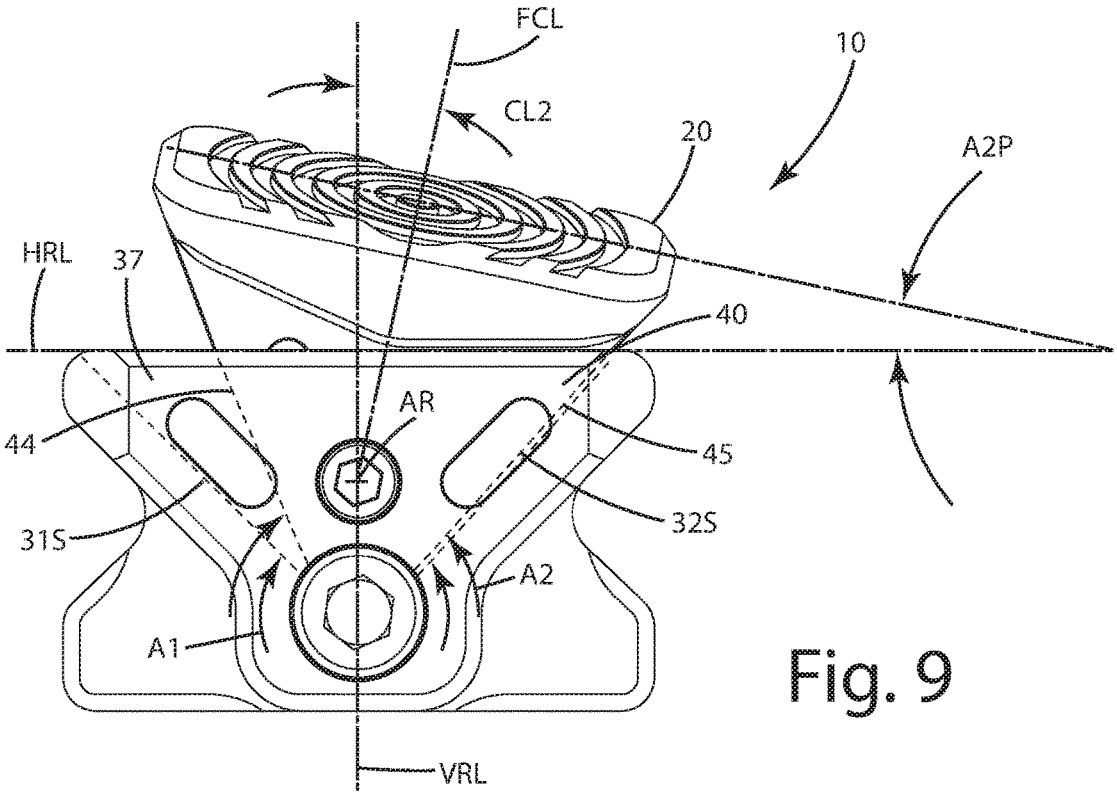
FIG. 9 is a front view of the index mount in the second position canted at a forward angle.

As shown in FIGS. 2 and 3, the mounting base 30 can include the above-mentioned side wall 30S. The mounting base 30 can include an upper portion 30U and a lower portion 30L. The upper portion 30U can define a flange cradle 37. This flange cradle can be bounded by the side wall 30S, a first base stop 31S and a second base stop 32S. The first base stop and second base stop, as shown in FIG. 9 can be angled relative to one another at angle A1. As mentioned above, the connector flange 40 can include a first edge 44 and a second edge 45. These edges can be disposed at another, different angle A2 relative to one another. The angle A1 can be greater than the angle A2. In this manner, the connector flange 40 can be moved forward and rearward within the cradle recess 37, while pivoting about the axis of rotation AR, as described below.

Figure 8:
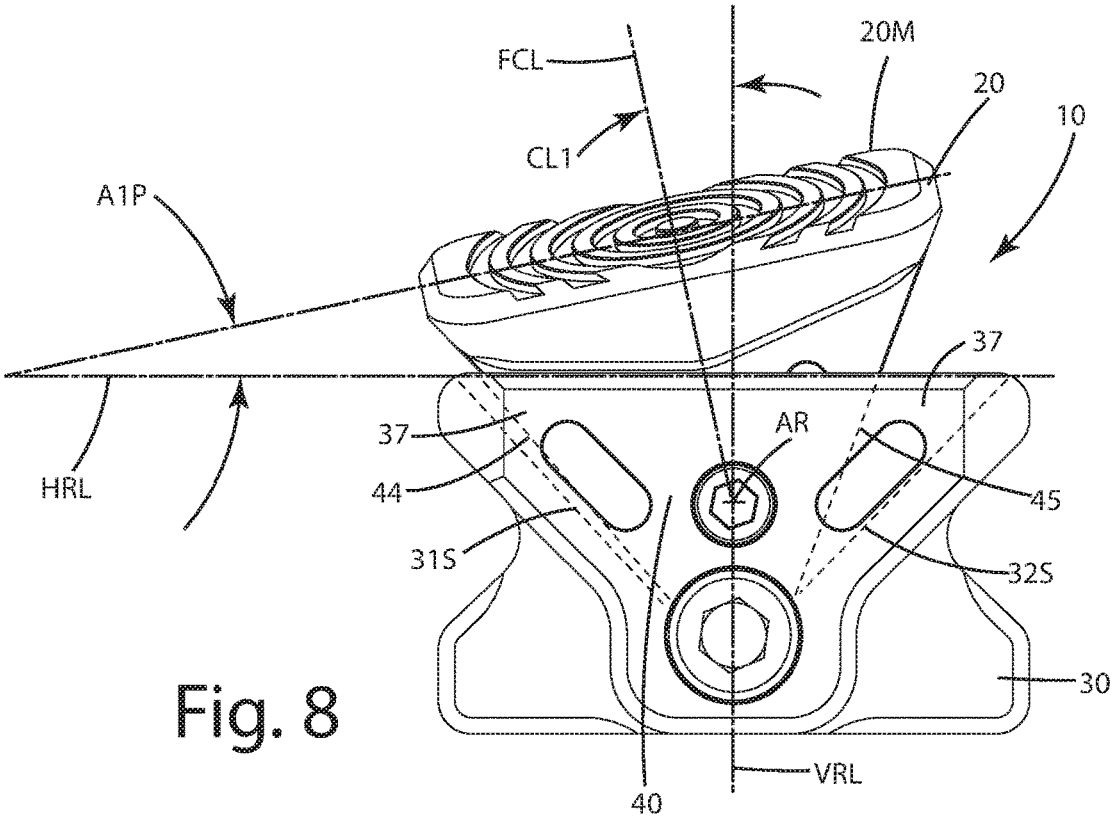
FIG. 8 is a front view of the index mount in the first position canted at a rearward angle.

The mounting base 30 can include an interior surface 30I and an exterior surface 30E. The interior surface 30I can face toward the firearm 100. The exterior surface 30E can face away from the firearm 100. The mounting base 30 can include an upper surface 39 that can be any generally planar configuration. This upper surface 39 can include a coincident horizontal reference line HRL as shown in FIGS. 8 and 9. The mounting base 30 can include a vertical reference line VRL that can be parallel to the exterior surface 30E of the mounting base 30. This vertical reference line VRL also can be referred to as a base centerline which is aligned with the vertical center of the base. The horizontal reference line and the vertical reference line are described below in connection with other angles related to the paddle and its surfaces.

The index mount 10 can include a mounting fastener 36 that joins with a mounting nut 37, which as used herein can be referred to as a mounting element. In some cases, to accommodate different types of handguards, another mounting element 38 can be disposed between the mounting nut 37 and the mounting fastener 36. This other mounting element 38 can generally match the pattern and/or type of holes defined by handguard 106 to securely fasten the mounting base to the handguard. Of course, in other cases, the mounting element 38 can be absent from the index mount 10, with the base 30 secured to the firearm surface via the fastener 36 and the nut 37. In other applications, different types of fasting elements can be utilized to join the index mount with the handguard.

As shown in FIG. 7, the mounting base 30 can be fastened or otherwise clamped to the handguard 106. In particular, the handguard 106 can include an outwardly projecting surface 106A and a generally vertical surface 106B that transitions to that outward surface 106A. These surfaces can be at an angle relative to one another. As shown, multiple other surfaces can be joined with the surfaces 106A and 106B, to collectively form an octagon-shaped handguard. Of course, the surfaces 106A and 106B can be joined with one another, forming a single rounded surface. As mentioned above, the handguard can define one or more holes 106H. The fastener 36 can project through the hole 106H. Nut 37 can be joined with the threads of the fastener 36 and tightened to secure or clamp the mounting base 30 directly to and against the firearm and handguard mounting surface 106B. The mounting base 30 can project upward alongside the mounting surface 106B in a generally vertical orientation. As described below, the paddle 20 can jut inward, toward the bisecting plane BP of the firearm 100 generally over the outward projecting surface 106A. This can reduce the lateral profile LP of the index mount and firearm 100 relative to the bisecting plane BP. The paddle projects toward the bisecting plane BP rather than outward, away from that plane, substantially beyond the mounting base 30.

Returning to FIG. 2, the mounting base 30 can include a second indexing element or set of indexing elements 31 and 32. These indexing elements can be in the form of protrusions, such as posts, ridges bumps, detents, bearings or other components that are configured to engage the first indexing elements on the connector flange 40. Although shown with the recesses defined by the connector flange and the protrusions included in the base 30, these indexing elements can be reversed, with the protrusions on the connector flange and the recesses on the mounting base. Further, there may additional numbers of indexing elements on each of the respective flange 40 and base 30. With an increased number of such indexing elements, adjustment of the paddle relative to the mounting base and firearm can be of significant number. Further, in some cases, the indexing elements can be absent, in which case, the connector flange 40 can be torqued or fastened tightly and removably to the mounting base via the pivot fastener 40P.

Optionally, the indexing elements can be in the form of multiple ridges projecting from the connector flange, and multiple corresponding valleys defined in the sidewall of the mounting base. Of course, these structures can be reversed. Further, the number of ridges can be less than the number of valleys or vice versa, depending on the set up of the indexing elements.

With reference to FIG. 7, the paddle 20, as mentioned above can include the upper surface 20U. The upper surface can be in the form of a generally planar structure that has a textured gripping surface. The upper surface can be canted at an outward angle OA. This outward angle OA can be optionally between 45° and 90°, inclusive, between 55° and 85°, inclusive, between 65° and 80°, inclusive, or about 75°, relative to the vertical reference line VRL of the mounting base 30. With this outward angle OA, the upper surface 20U can be more ergonomically configured to receive the thumb T of a user. Of course, although not shown, this paddle outward angle can be changed depending on the application. Generally, however, the ranges of outward angles described herein can provide a suitable resting surface and angle of the upper surface to accommodate a variety of user's thumbs. Further, as noted above, the upper surface 20U can be disposed at multiple cants and angles. For example, as shown in FIG. 7, the upper surface 20U is disposed at the canted at the outward angle OA, which can be optionally about 75°. The upper surface 20U can be canted at this angle relative to the vertical reference line VRL, regardless of the position in which the paddle 20 is disposed.

As mentioned above, the paddle can be selectively configurable in a plurality of different positions, canted rearward or canted forward or neutral (0° or 180°), depending on the particular application and construction of the index mount. For example as shown, the index mount is securable in defined first or second positions. An example, of the first position is shown in FIG. 8 and an example of the second position is shown in FIG. 9. These positions are shown with specific angles, however, these angles can vary depending on the application.

In these different positions, the paddle, connector flange and mounting base can be oriented differently relative to one another. For example, with reference to FIG. 8, the paddle 20 and its upper surface 20U are in a first position. In this first position, the paddle can establish the upper surface in a particular orientation relative to the firearm to index a digit of the user relative to the firearm. In this configuration, the upper surface 40U is canted at a rearward angle A1P and generally is rearwardly canted. This angle A1P can be optionally between 1° and 45°, inclusive, between 5° and 30°, inclusive, between 10° and 20°, inclusive, or about 12°, relative to the horizontal reference line HRL when the paddle is in the first position as shown in FIG. 8. In this configuration as well, the connector flange centerline FCL can be disposed at a first angle CL1 relative to the base centerline or vertical reference line VRL. This first angle CL1 optionally can be equal to the angle of the forward angle A1P which the upper surface 20U is oriented.

When the paddle is in this canted configuration, and the upper surface is disposed at the rearward angle A1P, the rear edge 20E of the paddle is closer to the handguard surface 106A than the front edge 20F is to the handguard surface 106A. However, there still can be a gap G between the rear edge of the paddle and the handguard surface 106A, even though the paddle projects inward over the handguard surface like a shelf.

As mentioned above, the paddle 20 can be secured and locked in this configuration via the interaction of the connector flange and the mounting base. For example, with reference to FIG. 3, the connector flange is mounted in the cradle recess 37. One or more of the indexing elements or protrusions 31 and 32 can be positioned in one or more of the indexing elements or recesses 41A and 42A to align and set the connector flange and the paddle such that the paddle is in the first position relative to the mounting base 30, for example as shown in FIGS. 3 and 8. In this first position, the upper surface 20U is canted in a rearward angle A1P. The flange centerline FCL also is at the angle CL1 relative to the vertical reference line or centerline VRL of the mounting base as shown in FIG. 8.

In this first position, shown in FIGS. 3 and 8, the connector flange 40 also is positioned in the flange cradle 37 such that the first edge 44 of the connector flange 40 is adjacent and/or contacting the first base stop 31S. The second edge 45 of the connector flange in this configuration is distal from the second base stop 32S. In comparing FIG. 8, where the paddle 20 is in the first position and FIG. 9, where the paddle 20 is in the second position, the first edge 44 is closer to the first base stop 31S when in the first position than in the second position. Likewise, the second edge 45 is closer to the second base stop 32S when in the second position than in the first position.

The index mount 10 and paddle 20 are convertible from the first position shown in FIG. 8 to the second position shown in FIG. 9, and or a variety of other second positions, depending on the construction of the index mount. To convert the paddle from the rearward cant first position shown in FIG. 8 to a second position, for example, the one shown in FIG. 9, or any other positions, such as a neutral position, a user can, with reference to FIG. 3, rotate the pivot fastener 40P, such that it backs out of the connector flange hole 40H. As this occurs, the pivot fastener 40P can be rotated, but generally held in place in the mounting base hole 30H1. As this occurs, the mounting flange 40 and paddle 20 move in direction N, within the flange cradle 37, away from the sidewall. The first indexing elements or protrusions 31, 32 exit the first indexing holes or elements 41A and 42A. Due to the connector flange 40 being disposed in the cradle 37 of the mounting base 30, the connector flange and paddle remain nested in the mounting base, and do not fall away from the mounting base.

A user can exert a force F to push on the paddle 20. Accordingly, the paddle and connector flange rotate about the axis of rotation AR to transition the paddle from the first position to the second position. The connector flange and paddle are selectively rotatable about the axis of rotation to position the paddle in those positions, in any order, as well as other positions where the indexing elements are configured differently. During the rotation and the transition from the first position to the second position, the first edge 44 can move away from the first base stop 31S towards the second base stop 32S. The edges, connector flange and paddle in general can move about an arcuate path centered on the axis of rotation AR. The second edge 45 can move toward the second base stop 32S and away from the first base stop 31S, while also moving along an arcuate path about the axis of rotation AR.

A method of using the index mount 10 on the firearm 100 can include projecting the paddle 20 and its upper surface 20U over a second surface 106A of the firearm toward a bisecting plane BP of the firearm, such that the paddle 20 juts inward, over the second surface 106A and reduces the lateral profile LP of the paddle 20 on the firearm 100; and selectively configuring the paddle 20 in a first position or a second position relative to the mounting base 30, such that the upper surface 20U is canted at a rearward angle A1P that is between 1° and 45°, inclusive, relative to the horizontal reference line HRL when the paddle is in the first position, shown in FIG. 8, or such that the upper surface 20U is canted at another angle, for example, a forward angle A2P that is between 1° and 45°, inclusive, relative to the horizontal reference line HRL when the paddle is in the second position, shown in FIG. 9. In this manner, a user can selectively position the paddle 20 in the first position or the second position so that the user can engage the paddle with a digit and consistently establish a particular grip relative to the firearm.

Figure 5:
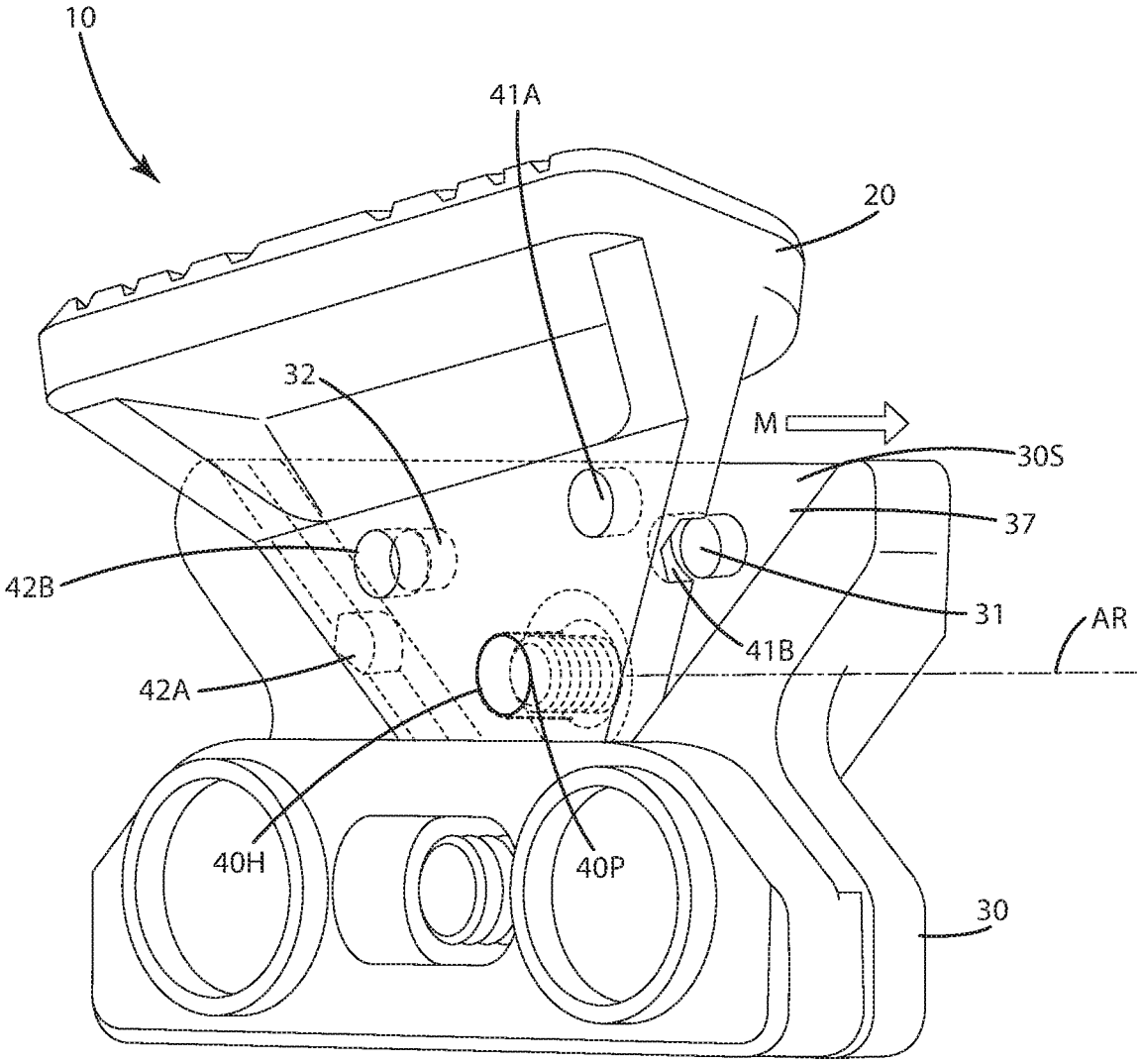
FIG. 5 is a rear view of the index mount acquiring a second position, with the indexing elements disengaged from one another and a connector flange having been moved in a flange cradle.
Figure 6:
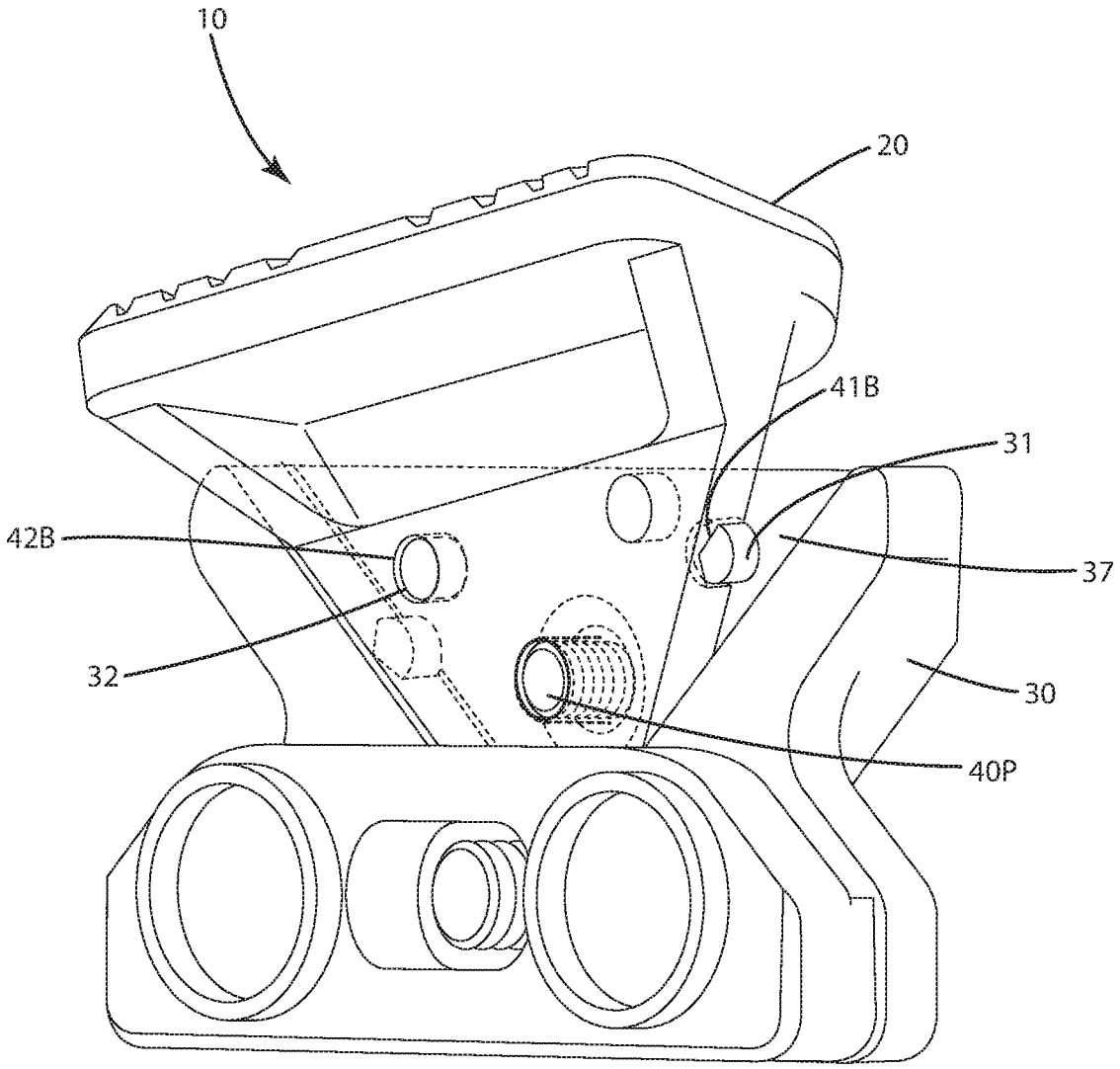
FIG. 6 is a rear view of the index mount canted forward in a second position, with indexing elements engaging one another.

After the force F is exerted and the paddle is selectively moved and transitions from the first position to the second position, which is shown in FIGS. 5 and 9, the paddle and connector flange can be secured in the second position. For example, as shown in FIG. 5, the first indexing protrusions 31 and 32 can be aligned with the second indexing elements or recesses 41B and 42B respectively. The pivot fastener 40P can be selectively tightened and threaded relative to the hole 40H of the connector flange 40. This in turn moves the flange in direction M toward the sidewall 30S. The pivot fastener can be tightened so that the connector flange is immovable relative to the mounting base. The protrusions 31 and 32 also enter the recesses 41B and 42B so that the paddle and connector flange are not rotatable relative to the mounting base in the flange cradle 37. As shown in FIG. 6, after the tightening is completed, the paddle 20 is secured and immovably disposed in the second position, which again is shown in FIGS. 6 and 9.

In this second position, the paddle can establish the upper surface 20U in particular orientation relative to the firearm to index a digit of the user relative to the firearm. In this configuration, the upper surface 20U is canted at a forward angle A2P or is generally forwardly canted. This angle A2P as shown can be optionally between 1° and 45°, inclusive, between 5° and 30°, inclusive, between 10° and 20°, inclusive, or about 12°, relative to the horizontal reference line HRL when the paddle is in the first position as shown in FIG. 9. In this configuration as well, the connector flange centerline FCL is at a second angle CL2 relative to the base centerline or vertical reference line VRL. This second angle CL2 can optionally be equal to the rearward angle A2P which the upper surface is oriented.

When the paddle and upper surface are in this forward canted configuration, and the upper surface is disposed at the rearward angle A2P, the forward edge 20F of the paddle is closer to the handguard surface 106A than the rear edge 20R is to the handguard surface 106A. However, there still can be a gap G between the forward edge of the paddle and the handguard surface 106A, even though the paddle projects inward over the handguard surface.

As can be seen, the connector flange 40 and paddle 20 of the index mount 10 can be selectively movable relative to the mounting base 30 so as to move the paddle from the first position to a second position relative to the mounting base. A user can thereby selectively position the paddle in the first position or the second position so that the user can engage the paddle with a digit and consistently establish a particular grip relative firearm.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. An adjustable index mount for a firearm, comprising:

a mounting base including an exterior surface and an interior surface;

a mounting element positioned to oppose the interior surface;

a mounting fastener joining the mounting base and the mounting element, the mounting fastener configured to be tightened to clamp a portion of a firearm between the mounting element and the mounting base to thereby secure the mounting base to the portion of the firearm;

a connector flange including a lower portion adjacent the mounting base and an upper portion extending away from the mounting base;

a paddle joined with the upper portion of the connector flange and configured to establish a resting surface to index a digit of a user relative to the firearm; and a first indexing protrusion joined with one of the connector flange and the mounting base, and a corresponding first indexing recess defined by the other of the connector flange and the mounting base, wherein the first indexing protrusion is positioned in the first indexing recess to set the paddle in a first position relative to the mounting base, wherein the connector flange is selectively movable relative to the mounting base so as to move the paddle from the first position to a second position relative to the mounting base, whereby a user can selectively position the paddle in the first position or the second position so that the user can engage the paddle with a digit and consistently establish a particular grip relative to the firearm.

2. The adjustable index mount of claim 1, comprising:

a pivot fastener extending through the mounting base and the lower portion of the connector flange, the pivot fastener including an axis of rotation;

wherein the connector flange and paddle are selectively rotatable about the axis of rotation to position the paddle in the first position or the second position.

3. The adjustable index mount of claim 2, wherein the mounting base includes a base centerline and the connector flange includes a flange centerline, wherein the base centerline is at a first angle relative to the flange centerline when the paddle is in the first position, wherein the base centerline is at a second angle relative to the flange centerline when the paddle is in the second position.

4. The adjustable index mount of claim 3, wherein the paddle includes an upper surface;

wherein the mounting base includes a vertical reference line;

wherein the upper surface is canted at an outward angle that is between 45° and 90°, inclusive, relative to the vertical reference line.

5. The adjustable index mount of claim 4, wherein the upper surface is canted at an outward angle that is about 75° relative to the vertical reference line.

6. The adjustable index mount of claim 1, wherein the paddle includes an upper surface;

wherein the mounting base includes a vertical reference line;

wherein the upper surface is canted at an outward angle that is between 55° and 85°, inclusive, relative to the vertical reference line.

7. The adjustable index mount of claim 1, comprising:

a second indexing recess defined by at least one of the connector flange and the mounting base, wherein the first indexing protrusion is selectively positioned in the second indexing recess to set the paddle in the second position relative to the mounting base.

8. The adjustable index mount of claim 1, wherein the mounting base defines a flange cradle, wherein the connector flange is disposed in the flange cradle, where in the mounting base includes a first base stop and a second base stop opposing one another across the flange cradle, wherein the connector flange includes a first edge and a second edge, wherein the first edge is adjacent the first base stop when the paddle is in the first position, wherein the second edge is adjacent the second base stop when the paddle is in the second position, wherein the first edge is closer to the first base stop when the paddle is in the first position than when the paddle is in the second position.

9. The adjustable index mount of claim 1, wherein the paddle includes an inner edge, wherein the inner edge of the paddle projects at least ⅛" beyond the interior surface of the mounting base, wherein the inner edge is disposed over the mounting element when the index mount is installed on a firearm, whereby the paddle is configured to extend over an outwardly projecting handguard surface so as to reduce the lateral profile of the paddle on the firearm.

10. The adjustable index mount of claim 1, wherein the paddle includes a lower surface, wherein the lower surface transitions to an interior surface of the connector flange, wherein the lower surface and connector flange form a handguard recess configured to receive a portion of a handguard such that the paddle and lower surface extend over the portion of a handguard to reduce a lateral profile of the index mount.

11. The adjustable index mount of claim 1, wherein the paddle includes an upper surface;

wherein the mounting base includes a horizontal reference line;

wherein the upper surface is canted at a rearward angle that is between 1° and 45°, inclusive, relative to the horizontal reference line when the paddle is in the first position, wherein the upper surface is canted at a forward angle that is between 1° and 45°, inclusive, relative to the horizontal reference line when the paddle is in the second position.

12. A adjustable index mount for a firearm comprising:

a mounting base including an exterior surface and an interior surface, the mounting base configured to be joined with a firearm, the mounting base including a vertical reference line and a horizontal reference line;

a connector flange including a lower portion joined with the mounting base and an upper portion extending away from the mounting base;

a paddle joined with the upper portion of the connector flange and configured to establish a resting surface to index a digit of a user relative to the firearm, the paddle including an upper surface, the upper surface being canted at an outward angle that is between 55° and 85°, inclusive, relative to the vertical reference line; and at least one indexing element configured to set the paddle in a first position or a second position relative to the mounting base, wherein the upper surface is canted at a rearward angle that is between 1° and 45°, inclusive, relative to the horizontal reference line when the paddle is in the first position, wherein the upper surface is canted at a forward angle that is between 1° and 45°, inclusive, relative to the horizontal reference line when the paddle is in the second position, wherein the connector flange is selectively movable relative to the mounting base so as to move the paddle from the first position to the second position relative to the mounting base, whereby a user can selectively position the paddle in the first position or the second position so that the user can engage the paddle with a digit and consistently establish a particular grip relative to the firearm.

13. The adjustable index mount of claim 12, wherein the paddle includes an inner edge, wherein the inner edge of the paddle is disposed at least ⅛" beyond the interior surface of the mounting base, whereby the paddle extends over an outwardly projecting handguard surface so as to reduce the lateral profile of the paddle on the firearm.

14. The adjustable index mount of claim 12, wherein the mounting base includes a mounting fastener and a nut, wherein the nut is tightenable relative to the fastener and configured to clamp a portion of the firearm between the nut and the mounting base to secure the index mount to the firearm, wherein the connector flange is secured to the mounting base with a pivot fastener aligned with an axis of rotation, wherein the mounting fastener is parallel to the pivot fastener, wherein the connector flange is configured to rotate about the axis of rotation to move the paddle from the first position to the second position.

15. The adjustable index mount of claim 12, wherein the mounting base defines a flange cradle, wherein the connector flange is disposed in the flange cradle, wherein the mounting base includes a first indexing element in the flange cradle, wherein the connector flange includes a second indexing element, wherein the first and second indexing elements are configured to interlock with one another to selectively hold the connector flange in at least one of the first position and the second position.

16. The adjustable index mount of claim 12, wherein the paddle forms a shelf that extends beyond the interior surface of the mounting base such that the shelf is configured to extend over an outwardly projecting handguard surface so as to reduce the lateral profile of the paddle on the firearm.

17. The adjustable index mount of claim 12, wherein the upper surface is canted at the outward angle that is between 70° and 80°, inclusive, wherein the upper surface is canted at the rearward angle that is between 10° and 20°, inclusive, relative to the horizontal reference line when the paddle is in the first position, wherein the upper surface is canted at the forward angle that is between 10° and 20°, inclusive, relative to the horizontal reference line when the paddle is in the second position.

18. A method of using an adjustable index mount on a firearm, the method comprising:

mounting a mounting base adjacent a first surface of a firearm with a mounting fastener, the mounting base including a horizontal reference line;

projecting a paddle having an upper surface over a second surface of the firearm toward a bisecting plane of the firearm, such that the paddle juts inward, over the second surface and thereby reduces a lateral profile of the paddle on the firearm;

selectively configuring the paddle in a first position or a second position relative to the mounting base, such that the upper surface is canted at a rearward angle that is between 1° and 45°, inclusive, relative to the horizontal reference line when the paddle is in the first position;

whereby a user can selectively position the paddle in the first position or the second position so that the user can engage the paddle with a digit and consistently establish a particular grip relative to the firearm.

19. The method of claim 18, wherein the selectively configuring includes rotating the connector flange about an axis of rotation to align a first indexing element with a second indexing element.

20. The method of claim 19 comprising:

rotating the connector flange in a flange cradle during the selectively configuring such that a first edge of the connector flange moves away from a first base stop and toward a second base stop of the mounting base, wherein during the rotating the upper surface of the paddle transitions from being canted at the rearward angle to being canted at a forward angle relative to the horizontal reference line.

* * * * *